US006415453B1

(12) United States Patent
Anderson et al.

(10) Patent No.: US 6,415,453 B1
(45) Date of Patent: Jul. 9, 2002

(54) LOW TEMPERATURE THERMAL INSULATION GARMENT UTILIZING THE WEARER'S EXHALANT

(75) Inventors: Abraham Anderson; Anita Sengupta, both of 168 N. Catalina Ave. #203, Pasadena, CA (US) 91106

(73) Assignees: Abraham Anderson; Anita Sengupta, both of Pasadena, CA (US)

( * ) Notice: Subject to any disclaimer, the term of this patent is extended or adjusted under 35 U.S.C. 154(b) by 0 days.

(21) Appl. No.: 09/952,109

(22) Filed: Sep. 11, 2001

(51) Int. Cl.[7] ..... A62B 17/00; A62D 5/00

(52) U.S. Cl. ..... 2/458; 2/67; 2/93; 2/97; 2/272; 2/2.11; 2/2.15; 2/2.16; 165/46

(58) Field of Search ..... 2/458, 2.11, 2.15, 2/2.16, 69, 93, 97, 272; 165/46

(56) References Cited

U.S. PATENT DOCUMENTS 1,648,438 A * 11/1927 Armbrust ..... 128/204.16
2,610,038 A * 9/1952 Phillips ..... 128/201.13
3,153,720 A * 10/1964 Petronio et al. ..... 128/DIG. 23
3,675,244 A * 7/1972 Mayo et al. ..... 2/2.16
4,038,698 A * 8/1977 Smith ..... 126/204
4,172,454 A * 10/1979 Warncke et al. ..... 128/201.29
4,457,295 A * 7/1984 Roehr ..... 126/204
4,458,680 A * 7/1984 Childers et al. ..... 128/201.23
4,547,906 A * 10/1985 Nishida et al. ..... 135/115
5,303,425 A * 4/1994 Mele ..... 2/102
5,774,902 A * 7/1998 Gehse ..... 2/2.14
5,921,467 A * 7/1999 Larson ..... 165/46

* cited by examiner

*Primary Examiner*—A Vanatta
*Assistant Examiner*—Robert H. Muromoto, Jr.

(57) ABSTRACT

A low-temperature thermal insulation garment is proposed for low-energy requirement, self-sustaining body temperature maintenance. The proposed garment uses the body's expired respiratory gases and natural thermal production capabilities to insulate and maintain a comfortable skin temperature. The garment provides a constant re-supply of heated air with each exhaled breath. The garment has a mouthpiece with a check-valve that shunts exhaled air into a network of channels and bladders that cover the entire body. The garment also consists of a heat reflective lining to reduce radiant heat loss and a neoprene outer layer providing conductive insulation, durability, and waterproofing. Inhaled air is heated prior to entering the mouthpiece due to heat exchange with warmer areas of the garment. This allows residual heat from the exhalant to be transferred to incoming air. The garment can be fitted with artificial air supply, worn as is, or under a pressurized suit.

5 Claims, 1 Drawing Sheet

LOW TEMPERATURE THERMAL INSULATION GARMENT UTILIZING THE WEARER'S EXHALANT

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND

This invention relates to thermal garments. In particular, this invention relates to a thermal insulation garment that provides the wearer, thermal protection from low temperature aquatic and terrestrial environments, utilizing the body's exhaled respiratory gases.

There are numerous extreme low temperature environments that human beings are exposed to requiring the use of thermal insulating garments and systems. Arctic scuba divers are exposed to temperatures as low as 0 degrees Celsius, the freezing temperature of water. Researchers living in Antarctica, and at high altitudes can be exposed to temperatures as low is minus 50 degrees Celsius. Future dwellers on the surface of Mars would be exposed to temperatures as low as minus 128 degrees Celsius. Each of these environments requires the use of a thermal insulating system in order for a human being to survive.

The function of any low temperature protection thermal garment is to retain the body's heat in order to provide the wearer a comfortable operating environment. Body heat loss is minimized by thermal garments in their various ways of minimizing heat transfer from the body to the cooler external environment. The garments are typically made of multiple layers of thermoprotective materials. Some of these materials are: Lycra, polypropylene, foam neoprene, fleece, compressed neoprene, vulcanized rubber, etc. There is usually an inner layer that wicks away moisture and sometimes this layer is also designed to reflect radiant heat back to the body. The middle layer is usually the main insulating layer that traps a fluid, air or water, between it and the body, enhancing overall insulation.

Thermal protection is essential for the aquatic environment of scuba divers. Water exposure temperatures range from a comfortable high of 30° C. (86° F.) to low of just above freezing, 0° C. (32° F.) in fresh water and −1.9° C. (28.58° F.) in seawater. The human body cools rapidly in water, as water conducts heat out of the body 20 times faster than standard atmospheric air. Therefore it is vital to provide thermal exposure protection over the duration of the dive. Dive times range from 30 minutes for typical open water dives to essentially unlimited dive times for commercial divers using a surface air supply. Typical thermal insulation garments focus on reducing the body's overall thermal conductivity to the water, with different technologies for arctic, standard, and tropical water environments. Heat loss underwater is primarily via conduction and convection to the water; radiation heat loss is minimal in comparison. Several solutions to the problem of keeping warm in extreme cold conditions are practiced in the commercial diving industry. Dry-suits are often used to provide a diver with thermal protection in water from 30 to 0 degrees Celsius. Dry-suits utilize a layer of unheated air between the diver's skin and water, as the means of insulation. The limitation of the dry-suit is that the air is supplied from the diver's air supply, which is at the ambient water temperature. The dry-suit exposes the skin to chilled air, which the body must then warm, resulting in continual body heat loss. Therefore the dry-suit provides an extremely limited exposure times, as there is no heating mechanism employed. Another thermal insulation system used in the commercial diving industry is the 'hot-water-machine'. The 'hot-water-machine' is used to pump heated water from the surface into the suit of divers at depth. There are some detractors to this method such as skin irritation from dirty water, scalding of the divers skin, the need for an external power source, and limited diving range. The main limitation of current aquatic thermal insulation garments is that they are passive systems that merely slow down the cooling process. Consequently, a diver can only remain in the water for a limited amount of time. Current diving thermal insulation systems that employ an active heating mechanism require the use of an external power source and connection to the surface.

Some of the coldest regions on Earth are the polar zones of the Arctic a nd Antarctic. The climates of polar lands vary greatly depending on their latitude, proximity of the sea, elevation, and topography. The lowest extreme surface temperatures in the winter are between −54° and −46° C. (−65° and −50° F.). Precipitation and winds reduce the effective temperatures for human exposure in the arctic, as they facilitate convection between the body and external environment. Terrestrial cold-weather garments utilize trapped air as their means of insulation. Down-like layers or equally low-density synthetic materials provide a layer of air insulation, effectively reducing the wearer's overall thermal conductivity as well as providing water resistance and wind protection. Such garments are cumbersome and their effective use is limited to extremely short exposure times as there is no heating mechanism employed, only an insulating lower to slow down heat loss. Additionally there is no mechanism to prevent heat loss from the lung due to the natural breathing cycle.

Although there have been no humans on Mars to date, there is still much work being performed on developing thermal insulation technologies to protect humans from the severe temperature extremes and well as the low-pressure environment they will be exposed to. The average temperature for the Martian surface is −53° C. (−64° F.), with temperature extremes of −128° C.(−199° F.) on a winter night up to 36.8° C. (98.3° F.) on a warm summer day. Atmospheric pressure on Mars averages 0.01 atm or 10 mb. As a consequence of the low atmospheric pressure, radiation is the main mode of heat transfer. During high surface winds, however, heat loss due to atmospheric convection is increased. Currently derivatives of spacesuits or pressurized heated modules are the methods under consideration for thermal protection on the surface. The limitations of spacesuits are the extreme cost and lack of mobility. Pressurized heated modules are also expensive and inefficient.

Thus, in accordance with this background an improved low temperature thermal insulating garment is proposed that will extend the duration of exposure and the wearer's mobility by providing an exhalant based, self-sustaining, means of body temperature maintenance.

BRIEF SUMMARY:

The present invention provides thermal control and maintenance for low temperature environments.

An object of the invention is to provide thermal protection for low temperature terrestrial environments as low as negative 50 degrees Celsius.

Another object of the invention is to provide thermal protection for low temperature diving environment as low as zero degrees Celsius.

Another object of the invention is to provide thermal protection under pressurized space or surface suits for use on the surface of mars.

Another object of the invention is to provide extended dive times exceeding that of current diving thermal insulation garments and systems.

Another object of the invention is to provide unlimited exposure times for low temperature terrestrial environments.

Another object of the invention is to provide the wearer with increased mobility over current thermal insulating systems for low temperature environments.

Another object of the invention is to provide low-energy requirement and selfsustaining body temperature maintenance.

Another object of the invention is to use the body's expired respiratory gases and natural thermal production capabilities to insulate and maintain a comfortable skin temperature.

Another object of the invention is to promote an even distribution of heated air over the entire body surface, including the head, hands, and feet, in a rapid manner.

Another object of the invention is to reduce heat loss during the breathing cycle.

Another object of the invention is to use the body's expired gasses to warm incoming air.

Another object of the invention is to reduce water vapor lost from the lungs.

Another. object of the invention is to prevent the deleterious effects of excess water vapor inside the garment.

Another object of the invention is to provide a waterproof exterior.

Still another object of the invention is to mate with an external pressurized air supply.

This invention consists of a close fitting garment within which continuously flows the wearer's heated exhalant (expired gasses). The garment recycles the heat in exhaled gas by using it to establish a warm microclimate around the wearer. A mouthpiece with a check-valve shunts exhaled air to the garment. The inner surface of the mouthpiece is textured to promote warming and humidification of the inhaled air. In order to facilitate heat flow within the garment, a network of flexible channels and bladders carry the heated gasses from the mouthpiece outlet over the entire body surface. This provides a constantly re-supplied warm insulation layer, substantially increasing exposure time to the low temperature environment. The garment also reduces radiant heat loss with a reflective layer and provides further conductive insulation with an external waterproofing-neoprene layer. Lastly, inhaled air is directed through the network of channels. in the garment to heat it before entering the mouthpiece, reducing heat loss due to the natural breathing cycle. All of these aspects combine to provide substantial improvements over current low temperature thermal garments with regards to extended exposure times, high mobility, and self-sufficiency.

BRIEF DESCRIPTION OF THE DRAWING VIEWS

DETAILED DESCRIPTION OF THE INVENTION

Thermal insulation technology has a long history and in some cases very sophisticated implementation. Current state of the art blocks all forms of heat loss due to conduction, convection, and radiation. Thermal insulation garments can be found or made to fit almost any climate. The one area not effectively covered is heat convection at the mouth and evaporative heat exchange in the lung.

Figure 1:
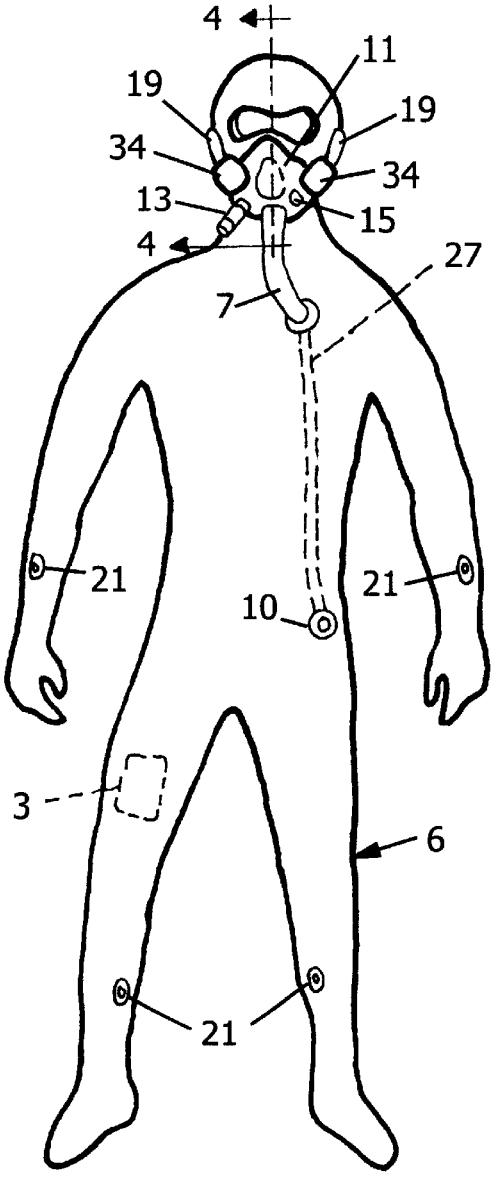
FIG. 1 illustrates the fill thermal garment viewed frontally.

The proposed thermal garment 6, illustrated in FIG. 1, is based on recovering and utilizing the heat associated with exhalation and reduction in heat loss to the exposure environment during inhalation. This passive system is designed to maintain a comfortable skin temperature in low temperature exposure environments. The techniques employed in the garment's 6 design also bring added benefits such as recycling of exhaled water vapor and concomitant gasses, and use in multiple exposure mediums. But the key benefits of the proposed garment 6 over current technology are extended exposure times, resource utilization efficiency, a passive design with no additional power requirements, and operator comfort, mobility, and work efficiency.

Figure 2:
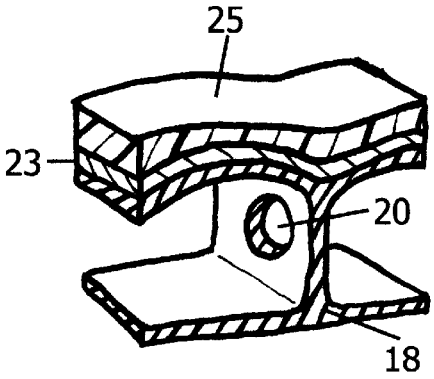
FIG. 2 is an oblique sectional view of the area enclosed by line 3 in FIG. 1, showing the garment's second stage layers and construction.
Figure 3:
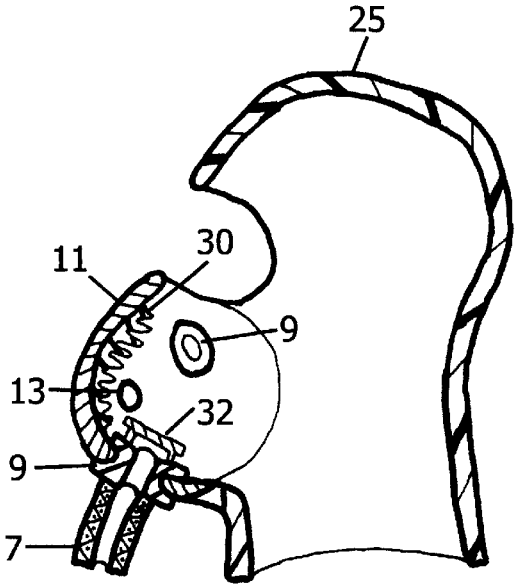
FIG. 3 is a sectional view taken on line 4 in FIG. 1, showing the garment's first stage and a connected portion of the garment's second stage.

Exhaled gases contain self-generated heat that is usually lost to the environment. The garment's 6 internal flow network returns this heated mixture of water vapor and atmospheric gasses to the body reducing overall energy loss. This simple recycling system not only directly warms the skin, but also enhances overall insulation efficiency by adding a non-conducting warm gas layer between the body and environment. The respiratory system of the garment 6 consists of a first stage and second stage. The first stage of the garment 6 is a mask that covers the nose and mouth, FIG. 3. It utilizes check valves 9 to separate inhaled and exhaled gases. The first stage controls the flow, separation, and redirection of inhaled and exhaled gases. An inlet port 10 allows air to be supplied by the environment or serve as a connection point for a contained supply of air. During inhalation, the check valve 9 allows air from the environment or pressured air (oxygen) supply to enter the breathing space 11 through the garment's 6 air supply tube 7. During exhalation the other check valves 9 shunt the expired gasses into the second stage. The mask is designed with two safety mechanisms; a redundant air supply connection 13 and a pressure relief valve 15 in case of abnormally high second stage pressures. The inner surface of the mask is also designed to promote water condensation and evaporation. This will be discussed later in the water recycling section. The second stage is the internal flow network of the garment 6, through which the exhaled gases flow, sectionally illustrated in FIG. 2. The second stage has three primary layers that serve to transfer heat from the internal flow of exhalants to the skin and prevent heat loss to the environment (FIG. 2). The layer closest to the skin contains the constantly flowing exhaled mixture of gases. The gases flow within these interconnected, flexible, polymer bladders 18, whose flow path extends from the head to the hands and feet. As the gas exits the first stage, it travels through tubes 19 over the head, and down into the upper body section. The tubes 19 then branch off into a network of bladders 18 encompassing the arms, back, abdomen, and legs. The gas bladder 18 network has a constant re-supply of exhaled gases, a product of the human respiratory process. The construction of the inner gas flow network promotes the free flow of gasses throughout the garment 6, heating the maximum dermal area. Its cancellous structure, consisting of long bladders 18 with intermittently perforated walls 20, facilitates airflow, while resisting permanent compression. Using conventional materials, the gas dispersal pattern would be localized to an area close to the inlet ports. The garment's 6 dispersal area is. maximized by using a custom engineered structure drawing inspiration from bronchial structure. The lung's branching pathways carry air far from the trachea, maximizing the area of the lung in contact with the freshly inhaled gas. Such a branching structure within the inner layer would carry the warm gas a distance before it entered the smaller spaces that constitute the inner conductive layer. This would maximize the dermal area warmed by the exhalant.

Exit ports 21 for constantly flowing gases are placed where the garment 6 is coolest This minimizes energy lost to the environment. These exit ports 21 are also fitted with vent/relief valves to prevent channel over-pressurization in the event of a blockage and also to counteract flow resistance. The exit ports 21 and vent/ relief valves, located on the forearms and calves of the garment 6, provide a continuous flow path for the re-supply of exhalant. An emergency relief valve 15 is also placed in the first stage in the event of a complete channel blockage.

The next layer of the garment 6 is a 1 mm layer of 16-sheet, reflective foil, Multi-layer insulation (MLI) 23. This layer 23 is used to reduce radiant heat loss through the garment 6, to the exposure environment. The outermost layer 25 is a neoprene insulator used to provide thermal insulation, garment 6 structure, mobility, waterproofing, and comfort.

The garment 6 design also reduces heat lost due to inhalation of cold gases, by preheating inspired gases. A warming tube 27 containing cooler air from the environment or an external air supply is cross-flowed, within the garment 6, with a portion of the expired gases to raise its temperature. Heat from the warm waste gasses is essentially absorbed by the cooler gas destined for the lung. This simple counter-flow heat exchanger design results in warmer inspired gasses, which absorb less heat from the lung. This type of heat exchange can be found in the human body itself and is abstracted in a multitude of industrial applications. In the body, cooler arterial blood is flowed alongside warmer venous blood. Heat is exchanged here to keep the heat internally and reduce loss at the lung.

Expired water vapor removal is a key design consideration, as it may condense within the thermal insulation mechanism. Uncontrolled condensation may lead to reduced insulation efficiency, premature degradation of the insulating material and potential icing conditions in the first 15 and second 21 stage exit ports. The water vapor maintenance system is unique as it incorporates reuse of water vapor, not just removal. The water vapor recovery system employs micro-textured vanes 30 molded onto the inner surface of the breathing space 11 that isolates the nose and mouth. A baffle element 32 is also placed in the air flow path to maximize air contact with the micro-textured vanes 30. During exhalation water vapor condenses onto the inner surface of the breathing space 11. The amount of condensation is greatly enhanced due to the large surface area provided by the textured, vane 30 structures. During inhalation, the cooler incoming air evaporates this trapped water and returns it into the airways of the lung. As discussed earlier, higher humidity levels in the lung reduce evaporative body heat loss. In addition, providing humidified incoming air reduces dry-mouth, a common discomfort associated with regulated air supply applications and cold conditions. The excess water vapor removal system consists of a housing 34 for removable desiccant cartridges placed before the entrance to the second stage. During exhalation, these cartridges will remove residual water vapor not recovered earlier. They can be replaced as necessary.

We claim:

1. A heat recycling garment, worn to provide thermal protection to a wearer's body from low temperature environments, said garment utilizing the wearer's own expired respiratory gases to continuously transfer heat back to the wearer's body, via direct conductive heat transfer to the skin's surface, said garment further comprises a means for the continuous capture of the wearer's exhaled gases, and the controlled direction of the wearer's exhaled gases through a network of interconnected channels and bladders whose flow path extends from said means of gas capture over the entire body, extending to the hands and feet, and a means for the continuous controlled transfer of the gas's thermal energy back to the wearer's body surface.

2. A heat recycling garment according to claim 1, wherein said gas-capture means shunts exhaled air into said gas-direction means, via a tube fitted with a unidirectional-valve.

3. A heat recycling garment according to claim 1, wherein said means for gas capture is a space covering the wearer's nose and mouth, said means is fitted with vent/relief valves to prevent over-pressurization in the event of a blockage and to counteract flow resistance in said gas-direction means.

4. A heat-recycling garment, worn to provide thermal protection to a wearer's body from low temperature environments, said garment utilizing the wearer's expired respiratory gases to transfer heat back to the wearer's body, said garment comprises a gas-capture means and a means for the dispersal and controlled transfer of the gas's thermal energy to the wearer, said dispersal and transfer means further comprising several layers:

- a cancellous polymer layer forming channels and bladders within which flows exhaled gases,
- a water-resistant fabric layer,
- a foil multi-layer insulation for reflecting radiant heat back to the body surface, and
- an outermost layer which reduces heat conduction from the garment's inner layers to the environment.

5. A heat-recycling garment according to claim 4, wherein said cancellous polymer layer is fitted with exit ports for constantly flowing gases contained therein, said ports allow said gases to escape to the environment and are placed at sites on the arms and legs where the garment is cooler, thus minimizing energy lost to the environment.

* * * * *